US009286841B2

(12) United States Patent
Moon et al.

(10) Patent No.: US 9,286,841 B2
(45) Date of Patent: Mar. 15, 2016

(54) EMBEDDED DISPLAYPORT SYSTEM AND METHOD FOR CONTROLLING PANEL SELF REFRESH MODE

(71) Applicant: SILICON WORKS CO., LTD., Daejeon-si (KR)

(72) Inventors: Yong Hwan Moon, Incheon-si (KR); Hong Jun Yang, Goyang-si (KR); Sang Ho Kim, Gunpo-si (KR); Yong Woo Kim, Chungbuk (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 326 days.

(21) Appl. No.: 13/869,619

(22) Filed: Apr. 24, 2013

(65) Prior Publication Data

US 2013/0278591 A1 Oct. 24, 2013

(30) Foreign Application Priority Data

Apr. 24, 2012 (KR) ..... 10-2012-0042706

(51) Int. Cl.
*G09G 3/36* (2006.01)
*G09G 5/00* (2006.01)

(52) U.S. Cl.
CPC ..... *G09G 3/3618* (2013.01); *G09G 5/006* (2013.01); *G09G 2370/12* (2013.01); *G09G 2370/14* (2013.01)

(58) Field of Classification Search
CPC . G09G 3/3618; G09G 5/006; G09G 2370/14; G09G 2370/12
See application file for complete search history.

(56) References Cited

U.S. PATENT DOCUMENTS 8,330,761 B2 * 12/2012 Lin ..... G09G 5/006 345/501
8,644,378 B2 * 2/2014 Liu ..... H03K 3/84 375/240.03
8,884,977 B2 * 11/2014 Wang ..... G09G 5/003 345/501
9,141,170 B2 * 9/2015 Kwa ..... G09G 3/3611

FOREIGN PATENT DOCUMENTS

KR 10-2009-0006740 1/2009
KR 10-2011-0137916 12/2011

OTHER PUBLICATIONS

Craig Raymond Wiley, "40.1: Invited Paper: DisplayPort 1.2, Embedded DisplayPort, and Future Trends" SID 11 Digest, pp. 551-554.
Seh Kwa et al., "Panel Self-Refresh Technology: Decoupling Image Update from LCD Panel Refresh in Mobile Computing Systems", SID 2012 Digest, pp. 644-646.

* cited by examiner

*Primary Examiner* — Andrew Sasinowski
(74) *Attorney, Agent, or Firm* — Kile Park Reed & Houtteman PLLC

(57) ABSTRACT

Provided are an embedded DisplayPort (eDP) system and a method for controlling a panel self refresh mode. The eDP system enters a panel self refresh (PSR) mode when an image to display is static in a general mode, and a sink device recovers a stream clock for displaying a static image in the PSR mode.

20 Claims, 3 Drawing Sheets

EMBEDDED DISPLAYPORT SYSTEM AND METHOD FOR CONTROLLING PANEL SELF REFRESH MODE

BACKGROUND OF THE INVENTION

1. Field of the Invention

The present invention relates to an embedded DisplayPort system, and more particularly, to an embedded DisplayPort system capable of implementing a panel self refresh mode and a method for controlling a panel self refresh mode.

2. Description of the Related Art

According to the recent development trend of display panels, a connection between an LVDS (Low Voltage Differential Signaling) signal and a timing controller has been replaced with an embedded DisplayPort.

The VESA (Video Electronics Standards Association) has suggested the standards of an embedded DisplayPort in a flat panel television on May 10, 2010, and the VESA Embedded DisplayPort Standard Version 1.3 has been published.

The VESA Embedded DisplayPort Standard Version 1.3 has proposed panel self refresh technology, and the panel self refresh (hereinafter, referred to as "PSR") technology proposes a method for reducing system-level power consumption.

According to the PSR technology, when an image displayed on the screen is static during a plurality of display frames, the static image is stored in a remote frame buffer and continuously displayed in a state where a source device of an embedded DisplayPort (hereafter, referred to as "eDP") system to transmit the image is turned off and a sink device (display panel device) of the eDP system is not turned off.

In the PSR mode, the source device of the eDP system is switched to a turn-off state. Therefore, system-level power consumption may be reduced as much as the source device is turned off.

Since the source device of the eDP system is turned off in the PSR mode, the source device does not transmit data to the sink device.

Therefore, until the PSR mode is ended, the sink device needs to generate a stream clock having the same frequency as before the PSR mode, in order to display an image stored in the remote frame buffer therein.

The eDP system uses a link symbol clock LS_CLK when the source device transmits data to the sink device.

For example, the link symbol clock LS_CLK has transmission rates of 270 M bytes/sec and 162 M bytes/sec based on one lane in a high bit rate (hereafter, referred to as "HBR") mode and a reduced bit rate (hereafter, referred to as "RBR") mode, respectively. Here, each of 270 M bytes/sec and 162 M bytes/sec is the speed of a clock used for data transmission between the source device and the sink device.

The sink device of the conventional eDP system receives a link symbol clock LS_CLK transmitted from the source device and stream data M and N generated by a source in a general mode in which an image displayed on the screen is not static, and recovers a stream clock required for displaying the image using the link symbol clock LS_CLK and the stream data M and N generated by the source.

In the PSR mode, however, the sink device of the eDP system does not receive a link symbol clock LS_CLK and stream data M and N from the source device because the source device is turned off.

Therefore, it is necessary to provide a method in which the sink device continuously recovers a stream clock having the same frequency as before the PSR mode, in order to display a static image in the PSR mode.

In order for the sink device to continuously recover a stream clock having the same frequency in the PSR mode, an internal or external oscillator having no difference in frequency between chips may be used in the source device and the sink device.

The eDP system may be configured in such a manner that the link symbol clock LS_CLK has a frequency of 270 MHz in the HBR mode and a frequency of 162 MHz in the RBR mode.

Therefore, when the internal or external oscillator having no difference in frequency between chips is used, the sink device may recover a stream clock using the link symbol clock LS_CLK generated by the internal or external oscillator or a clock corresponding to the link symbol clock LS_CLK as a reference clock.

That is, when the internal or external oscillator having no frequency difference between chips is used, the sink device stores stream data transmitted from the source device in a general mode. When entering the PSR mode, the sink device may recover a stream clock using the clock of the internal or external oscillator.

However, it is actually difficult to fabricate the internal oscillator having no difference in frequency between chips. Although an oscillator using an inductor-capacitor (L-C) tank with a small frequency difference is applied, there exists a frequency difference between chips. The oscillator using an L-C tank has a disadvantage in that it has a large chip size.

Furthermore, there is additionally needed a circuit for trimming the internal oscillator by comparing a link symbol clock recovered by a clock data recovery circuit and a clock generated by the internal oscillator in a general mode, in order to reduce the frequency difference between chips.

Although the clock of the internal oscillator is adjusted by the trimming circuit, there is a limit to the resolution of the trimming circuit. Therefore, it is difficult for the sink device to recover a stream clock having the same frequency as the link symbol clock LS_CLK.

Furthermore, an external oscillator such as a crystal oscillator has a constant frequency, but is expensive.

Therefore, the conventional eDP system requires a device capable of continuously recovering a stream clock having the same frequency as before the PSR mode such that the sink device displays a static image in response to the PSR mode.

Furthermore, the device to recover a stream clock in response to the PSR mode needs to be implemented at a low price and with a simple configuration.

SUMMARY OF THE INVENTION

Accordingly, the present invention has been made in an effort to solve the problems occurring in the related art, and an object of the present invention is to provide an eDP system capable of providing a stream clock to continuously display a static screen even in a condition in which a source device is turned off in response to a PSR mode of the eDP system.

Another object of the present invention is to provide an eDP system including a sink device capable of continuously recovering a stream clock having the same frequency as before a self refresh mode.

Another object of the present invention is to provide an eDP system in which a sink device generates a stream clock utilizing stream data calculated and stored based on a clock of an oscillator in a general mode when a source device enters a PSR mode, thereby continuously displaying a static image even in a condition in which the source device is turned off.

Another object of the present invention is to provide an eDP system in which a circuit to recover a stream clock in response to a PSR mode is inexpensive and simply implemented in a sink device.

In order to achieve the above object, according to one aspect of the present invention, there is provided an embedded DisplayPort (eDP) system including: a source device configured to stop providing a link symbol clock, first stream data having a fixed value, and second stream data having an unfixed value into which variation of the link symbol clock is reflected, when an image to display is static, and enter a panel self refresh (PSR) mode; and a sink device configured to store a number, obtained by counting an oscillator clock of an embedded oscillator while the link symbol clock is counted by a number corresponding to the first stream data, as first stored stream data, store a number, obtained by counting the stream clock during one period of a divided clock obtained by dividing the oscillator clock by the first stored stream data, as second stored stream data, and recover a stream clock using the oscillator clock and the first and second stored stream data when entering the PSR mode.

According to another aspect of the present invention, there is provided an eDP system including a timing controller configured to recover a stream clock. The timing controller includes: an oscillator configured to provide an oscillator clock; a stream data regeneration block configured to output a link symbol clock and first and second stream data, transmitted from a source device, as a reference clock and first and second regenerated stream data in a general mode, store a number, obtained by counting the oscillator clock while the link symbol clock is counted by a number corresponding to the first stream data, as first stored stream data, store a number, obtained by counting the stream clock during one period of a divided clock obtained by dividing the oscillator clock by the first stored stream data, as second stored stream data, and output the oscillator clock and the first and second stored stream data as the reference clock and the first and second regenerated stream data according to a panel mode signal in a PSR mode; and a stream clock recovery block configured to recover the stream clock using the reference clock and the first and second regenerated stream data.

According to another aspect of the present invention, there is provided an eDP system including a timing controller configured to generate a reference clock for recovering a stream clock. The timing controller includes: an oscillator configured to provide an oscillator clock; a first stored stream data generator configured to generate first stored stream data based on a number obtained by counting the oscillator clock while a link symbol clock transmitted from a source device is counted by a number corresponding to first stream data transmitted from the source device; a divider configured to divide the oscillator clock by the first stored stream data; a second stored stream data generator configured to generate second stored stream data based on a number obtained by counting a currently-output stream clock during one period of a divided clock outputted from the divider; a stream data buffer configured to store the first and second stored stream data and provide the second stored stream data to the divider; and a selection circuit configured to select and output the link symbol clock and the first and second stream data as the reference clock and first and second regenerated stream data in a general mode and select and output the oscillator clock and the first and second stored stream data stored in the stream data buffer as the reference clock and the first and second regenerated stream data in response to a panel mode signal in a PSR mode.

According to another aspect of the present invention, there is provided a method for controlling a PSR mode of an eDP system, including: storing a number, obtained by counting an oscillator clock provided from an oscillator while a link symbol clock is counted by a number corresponding to first stream data having a fixed value, as first stored stream data in a general mode; storing a number, obtained by counting a stream clock during one period of a divided clock obtained by dividing the oscillator clock by the first stored stream data, as second stored stream data in the general mode; and selecting the oscillator clock and the first and second stored stream data and providing the selected clock and data as a reference clock and first and second regenerated stream data for recovering a stream clock in a PSR mode.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
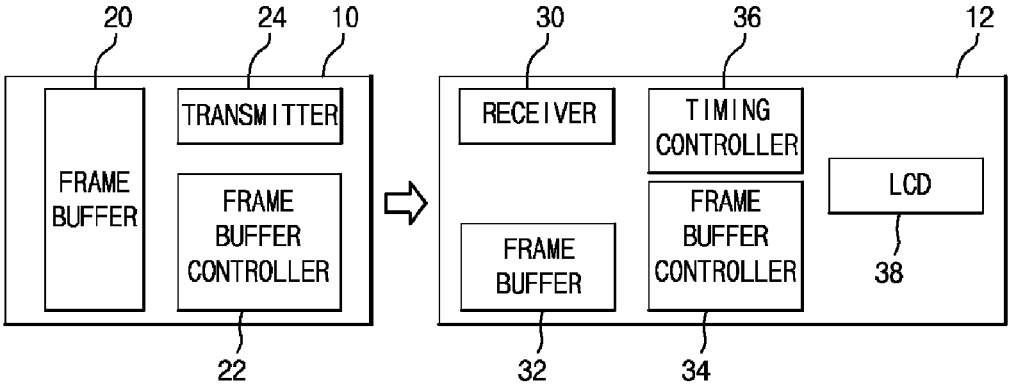
FIG. 1 is a block diagram illustrating an eDP system according to an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, an embedded DisplayPort (eDP) system according to an embodiment of the present invention includes a source device 10 and a sink device 12.

The source device 10 may have a variety of image sources to provide an image to display, and include a frame buffer 20, a frame buffer controller 22, and a transmitter 24.

The frame buffer 20 is a storing place to store an image to transmit in the unit of frame. The frame buffer controller 22 is configured to control an operation of storing an image in the frame buffer 20 in the unit of frame and an operation of outputting the image stored in the frame buffer 20 to the transmitter 24. The transmitter 24 is configured to convert the image data outputted from the frame buffer 20 into a signal form defined as a protocol.

The sink device 12 is a display device to display an image transmitted from the source device 10, and includes a receiver 30, a frame buffer 32, a frame buffer controller 34, a timing controller 36, and a liquid crystal panel (LCD) 38.

The receiver 30 is configured to receive the image transmitted from the source device and transmit the received image to the frame buffer 32. The frame buffer 32 is a storing place to store the image received through the receiver 30 in the unit of frame. The frame buffer controller 34 is configured to control an operation of storing an image in the frame buffer 32 in the unit of frame and an operation of outputting the image stored in the frame buffer 32 to the LCD 38. The timing controller 36 is configured to provide a stream clock STR_CLK such that the LCD 38 displays the image. The LCD 38 is configured to display an image.

In the above-described configuration, the source device 10 uses a link symbol clock LS_CLK when transmitting an image to the sink device 12.

For example, the link symbol clock LS_CLK has transmission rates of 270 M bytes/sec and 162 M bytes/sec based on one lane in the HBR mode and the RBR mode, respectively. According to the transmission rate of the link symbol clock LS_CLK, data are transmitted from the source device 10 to the sink device 12.

A clock for displaying an image is defined as a stream clock STR_CLK.

The source device 10 transmits first stream data N and second stream data M to the sink device 12 such that the sink device 12 recovers the stream clock STR_CLK using the link symbol clock LS_CLK.

The first stream data N and the second stream data M are defined in the VESA DisplayPort Standard Version 1.2, as expressed by Equation 1 below.

$$f_STR_CLK = \frac{M}{N} \times f_LS_CLK \quad \text{[Equation 1]}$$

Here, N is defined as (reference pulse period/t_LS_CLK), M is defined as (feedback pulse period/t_STR_CLK), f_STR_CLK represents the frequency of the stream clock STR_CLK, f_LS_CLK represents the frequency of the link symbol clock LS_CLK, t_STR_CLK represents a stream clock period, and t_LS_CLK represents the period of the link symbol clock LS_CLK.

That is, the source device 10 generates the first stream data N and the second stream data M using the stream clock STR_CLK, and transmits image data, the link symbol cock LS_CLK, and the first and second stream data N and M to the sink device 12. Then, the sink device 12 recovers the stream clock STR_CLK required for displaying an image, using the link symbol clock LS_CLK and the first and second stream data N and M.

The DisplayPort Standard clearly states that the values of the first and second stream data N and M are constantly maintained when a DisplayPort uPacket Tx and a stream source share the same reference clock.

That is, when the source device (stream source) 10 shares the same reference clock to generate the link symbol clock LS_CLK and the stream clock STR_CLK (synchronous clock mode), the source device 10 may use the first and second stream data N and M having a fixed and relatively small value. For example, a value of 64 or less may be used as the values of the first and second stream data N and M.

When the stream clock STR_CLK and the link symbol clock LS_CLK in the source device 10 are asynchronous to each other, the value of the second stream data M changes with time. When the source device 10 generates the stream clock STR_CLK and the link symbol clock LS_CLK through a method in which the stream clock STR_CLK and the link symbol clock LS_CLK are asynchronous to each other (asynchronous clock mode), the value of the second stream data M changes with time, but the first stream data N is maintained at a fixed value. Typically, the value of the first stream data N in the asynchronous clock mode is $2^{15}$ or 32768.

In the above-described asynchronous clock mode, a value obtained by counting the stream clock STR_CLK while the link symbol clock LS_CLK is counted by 32768 times corresponding to the value of the first stream data N may be set to the value of the second stream data M.

The sink device 12 may recover the stream clock STR_CLK which is to be used to display an image using the first and second stream data N and M transmitted from the source device 10.

The embodiments of the present invention provide an eDP system capable of implementing the panel self refresh technology proposed in the VESA Embedded DisplayPort Standard Version 1.3. Accordingly, the embodiments of the present invention provide a timing controller employing a panel self refresh mode and a method for controlling a panel self refresh mode.

The eDP system according to the embodiment of the present invention enters a panel self refresh mode, that is, a PSR mode to reduce system-level power consumption, when an image displayed on the screen is static during a plurality of display frames. In the PSR mode, the static image is stored and continuously displayed in a state where the source device 10 of the eDP system to transmit an image is turned off and the sink device 12 of the eDP system is not turned off.

When entering the PSR mode, the source device 10 neither transmits image data to the sink device 12 nor provides the link symbol clock LS_CLK and the first and second stream data N and M to the sink device 12.

Therefore, the embodiments of the present invention provide a technique for recovering a stream clock STR_CLK for displaying an image in the PSR mode. In order to distinguish from the PSR mode, a mode in which a non-static image is transmitted in a state where the source device 10 is turned on is defined as a general mode.

The eDP system according to the embodiment of the present invention, which operates in the general mode and the PSR mode, includes the source device 10 and the sink device 12 as illustrated in FIG. 1.

When an image to display is static, the source device 10 performs outputs a panel mode signal PMS for entering the PSR mode and is then turned off in the PSR mode.

The source device 10 generates first stream data N having a fixed value and second stream data having an unfixed value for regenerating a stream clock STR_CLK for an image to display in the general mode, using a stream clock STR_CLK and a link symbol clock LS_CLK, and outputs the link symbol clock LS_CLK and the first and second stream data N and M. The operation of the source device 10 may be controlled by a separate controller (not illustrated), and the link symbol clock LS_CLK and the first and second stream data N and M may be outputted, that is, transmitted by the transmitter 24.

The sink device 12 recovers the stream clock STR_CLK using the first and second stream data N and M and the link symbol clock LS_CLK in the general mode.

Figure 2:
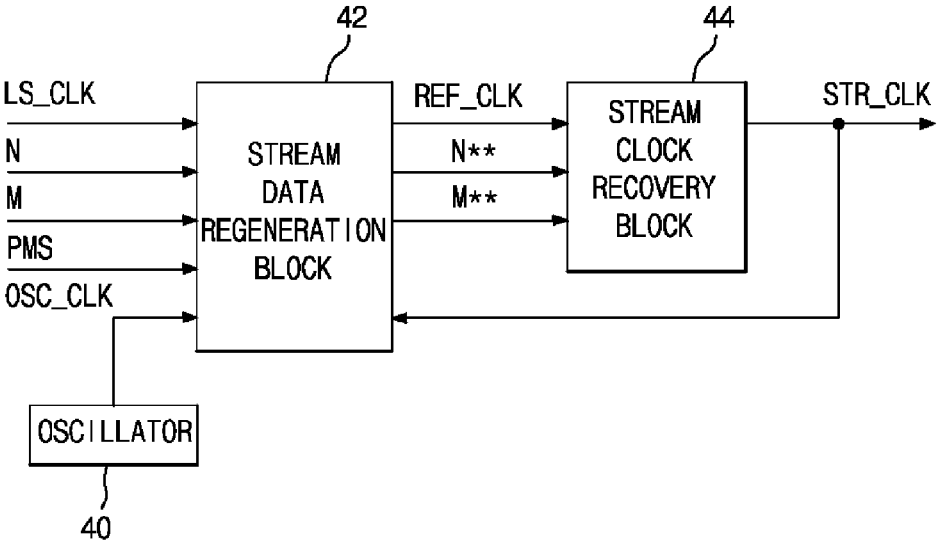
FIG. 2 is a block diagram illustrating a circuit implemented in a timing controller of FIG. 1.

Furthermore, the sink device 12 stores a number, obtained by counting an oscillator clock OSC_CLK of an embedded oscillator 40 as illustrated in FIG. 2 while the link symbol clock LS_CLK is counted by a number corresponding to the first stream data N, as a first stored stream data N*, and stores a number, obtained by counting a stream clock STR_CLK during one period of a divided clock obtained by dividing the oscillator clock OSC_CLK by the first stored stream data N*, as second stored stream data M*.

Furthermore, the sink device 12 selects the oscillator clock OSC_CLK and the first and second stored stream data N* and M* and recovers the stream clock STR_CLK in response to the panel mode signal PMS in the PSR mode.

The above-described operation of the sink device 12 will be described in more detail with reference to FIGS. 2 to 4.

The embodiments of the present invention provide a technique for recovering a stream clock STR_CLK to continuously display an image using the internal oscillator 40 even though the source device 10 is turned off in the PSR mode.

For this operation, the timing controller 34 according to the embodiment of the present invention may include a circuit as illustrated in FIG. 2. Specifically, the timing controller 34 includes the oscillator 40, a stream data regeneration block 42, and a stream clock recovery block 44.

The oscillator 40 generates and provides an oscillator clock OSC_CLK.

Figure 3:
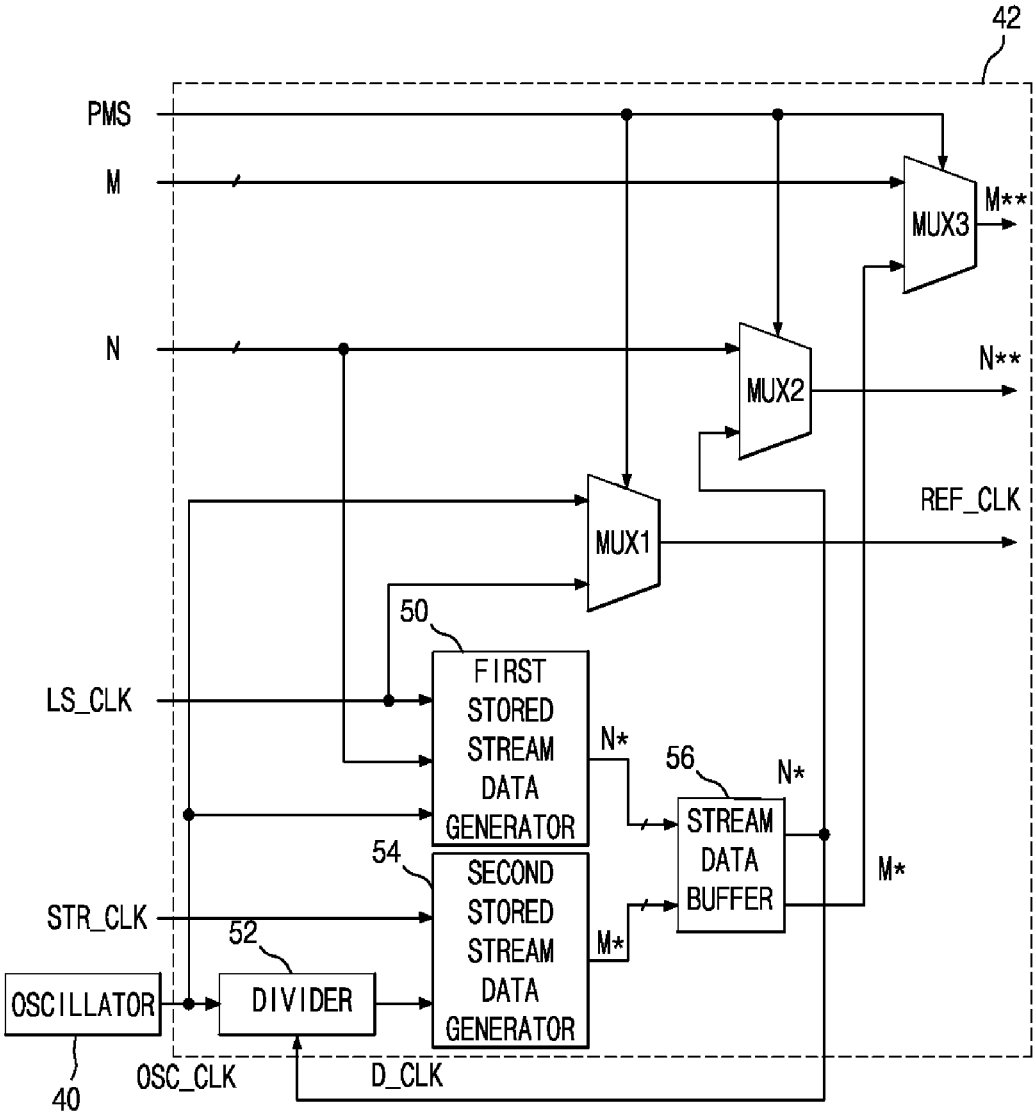
FIG. 3 is a detailed block diagram of a stream data regeneration block of FIG. 2.

The stream data regeneration block 42 may be configured as illustrated in FIG. 3.

In the general mode, the stream data regeneration block 42 outputs the link symbol clock LS_CLK and the first and second stream data N and M, transmitted from the source device 10, as a reference clock REF_CLK and first and second regenerated stream data N and M, stores a number, obtained by counting the oscillator clock OSC_CLK while the link symbol clock LS_CLK is counted by a number corresponding to the first stream data N, as the first stored stream data N*, and stores a number, obtained by counting the stream clock STR_CLK during one period of a divided clock D_CLK obtained by dividing the oscillator clock OSC_CLK by the first stored stream data N*, as the second stored stream data M*.

In the PSR mode, the stream data regeneration block 42 outputs the oscillator clock OSC_CLK and the first and second stored stream data N* and M* as the reference clock REF_CLK and the first and second regenerated stream data N and M in response to the panel mode signal PMS.

Figure 4:
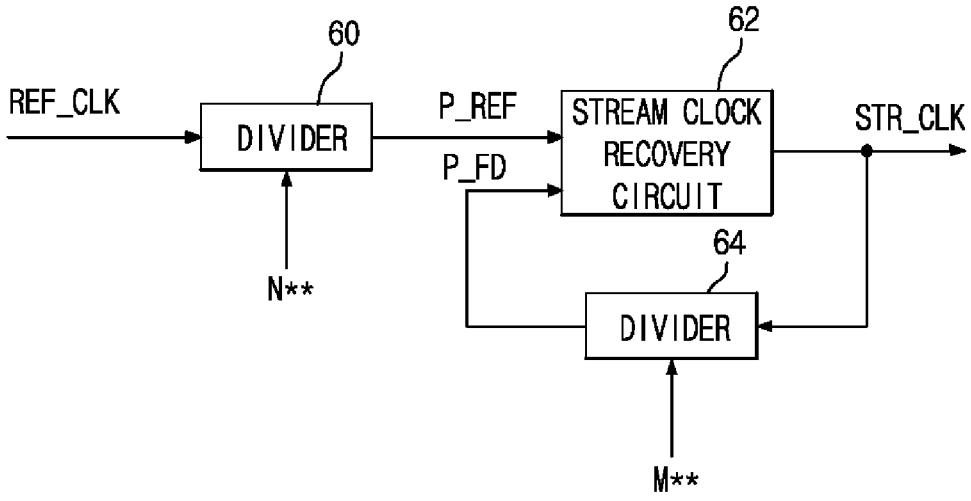
FIG. 4 is a detailed block diagram of a stream clock recovery block of FIG. 2.

The stream clock recovery block 44 may be configured as illustrated in FIG. 4. The stream clock recovery block 44 recovers the stream clock STR_CLK according to a result obtained by comparing a reference pulse P_REF and a feedback pulse P_FD. The reference pulse P_REF may be obtained by dividing the reference clock RFE_CLK by the first regenerated stream data N, and the feedback pulse P_FD may be obtained by dividing the output stream clock STR_CLK by the second regenerated stream data M.

In the above-described configuration, the panel mode signal PMS is a control signal to control PSR mode entry.

First, referring to FIG. 3, the configuration and operation of the stream data regeneration block 42 will be described in detail.

The stream data regeneration block 42 includes a first stored stream data generator 50, a divider 52, a second stored stream data generator 54, a stream data buffer 56, and a selection circuit.

In the above-described configuration, the first stored stream data generator 50 is configured to generate the first stored stream data N*. Specifically, the first stored stream data generator 50 generates the first stored stream data N* based on a number obtained by counting the oscillator clock OSC_CLK while the link symbol clock LS_CLK is counted by a number corresponding to the first stream data N.

The divider 52 is configured to divide the oscillator clock OSC_CLK by the first stored stream data N* and output the divided clock D_CLK.

The second stored stream data generator 54 is configured to generate the second stored stream data M* based on a number obtained by counting a currently-output stream clock STR_CLK during one period of the divided clock D_CLK outputted from the divider 52.

The stream data buffer 56 is configured to store and provide the first and second stored stream data N* and M*.

The selection circuit includes multiplexers MUX1, MUX2, and MUX3.

In the general mode, the selection circuit selects the link symbol clock LS_CLK and the first and second stream data N and M to recover the stream clock STR_CLK, and outputs the selected clock and data as the reference clock REF_CLK and the first and second regenerated stream data N and M.

In the PSR mode, the selection circuit selects the oscillator clock OSC_CLK and the first and second stored stream data N* and M* stored in the stream data buffer 56 to recover the stream clock STR_CLK in response to the panel mode signal PMS, and outputs the selected clock and data as the reference clock REF_CLK and the first and second regenerated stream data N and M.

That is, the multiplexer MUX1 is configured to select and output the link symbol clock LS_CLK in the general mode and select and output the oscillator clock OSC_CLK in the PSR mode, according to the panel mode signal PMS. The multiplexer MUX2 is configured to select and output the first stream data N in the general mode and select and output the first stored stream data N* in the PSR mode, according to the panel mode signal PMS. The multiplexer MUX3 is configured to select and output the second stream data M in the general mode and select and output the second stored stream data M* in the PSR mode, according to the panel mode signal PMS.

In the above-described configuration, the first and second stream data N and M, the first and second stored stream data N* and M*, and the first and second regenerated stream data N and M may be configured as 24-bit signals.

In the general mode, the first stored stream data generator 50 generates the first stored stream data N* using the link symbol clock LS_CLK, the first stream data N, and the oscillator clock OSC_CLK, and stores the first stored stream data N* in the stream data buffer 56. The divider 52 divides the oscillator clock OSC_CLK by the first stored stream data N* stored in the stream data buffer 56, and generates the divided clock D_CLK. The second stored stream data generator 54 generates the second stored stream data M* using a stream clock STR_CLK recovered by the stream clock recovery block 44 and the divided clock D_CLK outputted from the divider 52, and stores the second stored stream data M* in the stream data buffer 56.

In the general mode, the generation of the first and second stored stream data N* and M* is repetitively performed, and the first and second stored stream data N* and M* stored in the stream data buffer 56 are updated to the latest values at all times.

As described above, the first and second stored stream data N* and M* stored in the general mode are used to recover the stream clock STR_CLK in the PSR mode.

The relations among the link symbol clock LS_CLK, the stream clock STR_CLK, the oscillator clock OSC_CLK, the first stream data N, the second stream data M, the first stored stream data N*, and the second stored stream data M* may be established as follows. First, the relation between the link symbol clock LS_CLK and the stream clock STR_CLK may be expressed as Equations 2 and 3 below.

$$f_STR_CLK = \frac{M}{N} \times f_LS_CLK \quad \text{[Equation 2]}$$

$$\frac{N}{f_LS_CLK} = \frac{M}{f_STR_CLK} \quad \text{[Equation 3]}$$

Here, f_STR_CLK represents the frequency of the stream clock STR_CLK, and f_LS_CLK represents the frequency of the link symbol clock LS_CLK.

As described above, the DisplayPort Standard defines that the value of the first stream data is 32768 in the asynchronous clock mode. Furthermore, the DisplayPort standard defines that the value of the first stream data N is a fixed value of 64 or less in the synchronous clock mode.

Most display systems operate in the asynchronous clock mode. Therefore, when the above-described equations are described under the supposition that the current mode is the asynchronous clock mode, the value of the second stream data M indicates a number obtained by counting the stream clock STR_CLK while the link symbol clock LS_CLK is counted by N (32768) corresponding to the value of the first stream data.

The relation between the link symbol clock LS_CLK and the oscillator clock OSC_CLK may be expressed as Equations 4 and 5 below.

$$\text{f_OSC_CLK} = \frac{N^*}{N} \times \text{f_LS_CLK} \quad \text{[Equation 4]}$$

$$\frac{N}{\text{f_LS_CLK}} = \frac{N^*}{\text{f_OSC_CLK}} \quad \text{[Equation 5]}$$

Equations 4 and 5 indicate that the number obtained by counting the oscillator clock OSC_CLK while the link symbol LS_CLK is counted by N (32768) corresponding to the value of the first stream data is the first stored stream data N*.

The relation between the oscillator clock OSC_CLK and the stream clock STR_CLK may be expressed as Equations 6 and 7.

$$\text{f_STR_CLK} = \frac{M^*}{N^*} \times \text{f_OSC_CLK} \quad \text{[Equation 6]}$$

$$\frac{M^*}{\text{f_STR_CLK}} = \frac{N^*}{\text{f_OSC_CLK}} = \frac{1}{\text{f_D_CLK}} \quad \text{[Equation 7]}$$

Equations 6 and 7 indicate that the value of the second stored stream data M* is the number obtained by counting the stream clock STR_CLK while the oscillator clock OSC_CLK is counted by the value of the first stored stream data N* or during one period of the divided clock D_CLK.

Through the above-described equations, Equation 8 is acquired.

$$\frac{N}{\text{f_LS_CLK}} = \frac{N^*}{\text{f_OSC_CLK}} = \frac{M}{\text{f_STR_CLK}} = \frac{M^*}{\text{f_STR_CLK}} \quad \text{[Equation 8]}$$

According to Equation 8, it is possible to obtain a result that the value of the second stream data M is equal to the value of the second stored stream data M*.

However, since the link symbol clock LS_CLK and the stream clock STR_CLK are asynchronous to each other under the supposition of the asynchronous clock mode, the value of the second stream data M changes with time.

Furthermore, since the oscillator clock OSC_CLK and the stream clock STR_CLK are also asynchronous to each other, the value of the second stored stream data M* also changes with time.

Therefore, the value of the second stream data M and the value of the second stored stream data M* may differ from each other. However, a difference therebetween is only ±2 which is a minute value.

The first stored stream data generator 50 according to the embodiment of the present invention operates based on Equations 4 and 5.

That is, the first stored stream data generator 50 generates the first stored stream data N* based on the number obtained by counting the oscillator clock OSC_CLK while the link symbol clock LS_CLK is counted by the value of the first stream data N, and stores the first stored stream data N* in the stream data buffer 56.

Furthermore, the second stored stream data generator 54 according to the embodiment of the present invention operates based on Equations 6 and 7.

That is, the second stored stream data generator 54 generates the second stored stream data M* based on the number obtained by counting the stream clock STR_CLK while the oscillator clock OSC_CLK is counted by the first stored stream data N* or during one period of the divided clock D_CLK, and stores the second stored stream data M* in the stream data buffer 56.

In the general mode, the values of the first and second stored stream data N* and M* stored in the stream data buffer 56 are updated to new values at all times.

Therefore, when the first and second stream data N and M are not transmitted from the source device 10 in the PSR mode, the stream data regeneration block 42 may provide the oscillator clock OSC_CLK of the oscillator 40 and the first and second stored stream data N* and M* as the reference clock REF_CLK and the first and second regenerated stream data N and M to the stream clock recovery block 44.

The stream clock recovery block 44 may receive the reference clock REF_CLK and the first and second regenerated stream data N and M from the stream data regeneration block 42 even though the source device 10 is turned off in the PSR mode, continuously recover the same stream clock STR_CLK, and provide the recovered stream clock STR_CLK to display a static image.

Referring to FIG. 4, the stream clock recovery block 44 includes a divider 60, a stream clock recovery circuit 62, and a divider 64.

The divider 60 of the stream clock recovery block 44 generates a reference pulse P_REF by dividing the reference clock REF_CLK by the first regenerated stream data N. The divider 64 generates a feedback pulse P_FD by dividing the output stream clock STR_CLK by the second regenerated stream data M. The stream clock recovery circuit 62 compares the reference pulse P_REF and the feedback pulse P_FD and recovers and outputs the stream clock STR_CLK.

In the PSR mode, the stream clock recovery block 44 uses the first stored stream data N* provided as the first regenerated stream data N**, the second stored stream data M* provided as the second regenerated stream data N**, and the oscillator clock OSC_CLK provided as the reference clock REF_CLK. Therefore, the stream clock STR_CLK may be recovered as expressed as Equations 9 and 10.

$$\frac{N^*}{\text{f_OSC_CLK}} = \frac{M^*}{\text{f_STR_CLK}} \quad \text{[Equation 9]}$$

$$\text{f_STR_CLK} = \frac{M^*}{N^*} \times \text{f_OSC_CLK} \quad \text{[Equation 10]}$$

Referring to Equations 9 and 10, it can be seen that the stream clock STR_CLK is recovered by the first stored stream data N*, the second stored stream data M*, and the oscillator clock OSC_CLK.

Meanwhile, when the frequency of the link symbol clock LS_CLK is 270 MHz and the frequency of the stream clock STR_CLK is 55.9973 MHz, the first and second stored stream data N* and M* may be calculated as an example. At this time, the first stream data N has a fixed value of 32768.

First, according to Equation 3, the value of the second stream data M may be calculated as follows:

$$M = \frac{N}{\text{f_LS_CLK}} \times \text{f_STR_CLK}$$

$$M = \frac{32768}{270 \times 10^6} \times 55.9973 \times 10^6$$

$$M = 6795.998245.$$

Here, since the link symbol clock LS_CLK and the stream clock STR_CLK are in the asynchronous clock mode and the second stream data M is an integer value, the value of the second stream data M becomes 6796±1.

At this time, supposing that the frequency of the oscillator clock OSC_CLK is 101.25 MHz, the first stored stream data generator 50 may calculate the first stored stream data N* according to Equation 4 or 5, as expressed below.

$$N^* = \frac{N}{\text{f_LS_CLK}} \times \text{f_OSC_CLK}$$

$$N^* = \frac{32768}{270 \times 10^6} \times 101.25 \times 10^6$$

$$N^* = 12288$$

Since the link symbol clock LS_CLK and the oscillator clock OSC_CLK are in the asynchronous clock mode and the first stored stream data N* is an integer value, the first stored stream data N* becomes 12288±1. Therefore, the first stored stream data N* becomes one of 12287, 12288, and 12289.

Furthermore, when the value of the first stored stream data N* is 12287 according to Equation 6 or 7, the second stored stream data generator 54 may obtain 6795.445186 as the value of the second stored stream data M*. Since the second stored stream data M* has an integer value, the second stored stream data M* may become 6795±1.

Furthermore, when the value of the first stored stream data N* is 12288, the second stored stream data generator 54 may obtain 6795.998246 as the value of the second stored stream data M*. Since the second stored stream data M* has an integer value, the second stored stream data M* may become 6795±1.

Furthermore, when the value of the first stored stream data N* is 12289, the second stored stream generator 54 may obtain 6796.551306 as the value of the second stored stream data M*. Since the second stored stream data M* has an integer value, the second stored stream data M* may become 6796±1.

That is, the second stored stream data M* may become 6794, 6795, 6796, or 6797.

As described above, the values of the first and second stored stream data N* and M* and the oscillator clock may be used to select the frequency of the stream clock STR_CLK. As a result, although the link symbol clock and the first and second stream data are not provided from the source device 10 in the PSR mode, the sink device 12 may recover the stream clock STR_CLK.

Therefore, the internal oscillator may be used to recover a stream clock in response to the PSR mode in a state where an additional component such as a trimming circuit is excluded from the eDP system.

Furthermore, although oscillator output frequencies between chips are different from each other, the first and second stored stream data N* and M* corresponding to the oscillator clock OSC_CLK may be generated and used to recover the stream clock STR_CLK having the same state as the general mode in the PSR mode.

As a result, although the sink device of the eDP system enters the PSR mode, the eDP system may continuously recover a stream clock having the same frequency as the clock frequency before the PSR mode. Accordingly, the eDP system may continuously display a static screen even though the source device is turned off in the PSR mode.

Furthermore, as additional components such as a trimming circuit may be excluded, the circuit to recover a stream clock in response to the PSR mode may be simply implemented in the sink device, thereby supporting the panel self refresh mode in the eDP system.

According to the embodiments of the present invention, although the sink device of the eDP system enters the PSR mode, the eDP system may continuously recover a stream clock having the same frequency as before the PSR mode. Therefore, the eDP system may continuously a static screen even after the sink device enters the PSR mode.

Furthermore, as additional components such as a trimming circuit are excluded, the circuit to recover a stream clock in response to the PSR mode may be simply implemented in the sink device of the eDP system, thereby supporting the PSR mode.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. An embedded DisplayPort (eDP) system comprising:

a source device providing a link symbol clock, first stream data having a fixed value, and second stream data having an unfixed value; and a sink device configured to receive the link symbol clock, the first stream data, and the second stream data from the source device, store a number, as first stored stream data, based on an oscillator clock, the link symbol clock, and the first stream data, store a number, as second stored stream data, based on a stream clock, the oscillator clock, and the first stored stream data, wherein the source device is turned off in a panel self refresh mode and the sink device generates a recovered stream clock, the sink device comprises:

an oscillator configured to provide the oscillator clock;

a stream data regeneration block configured to output the oscillator clock, the first stored stream data, and the second stored stream data as a reference clock, first regenerated stream data, and second regenerated stream data in the panel self refresh mode; and a stream clock recovery block configured to recover the stream clock using the reference clock, the first regenerated stream data, and the second regenerated stream data to generate the recovered stream clock.

2. The eDP system of claim 1, wherein when the image to display is static, the source device provides a panel mode signal announcing the entry to the panel self refresh mode to the sink device and is then turned off.

3. The eDP system of claim 1, wherein the stream data regeneration block is configured to output the link symbol clock, the first stream data, and the second stream data as the reference clock, the first regenerated stream data, and the second regenerated stream data in a general mode.

4. The eDP system of claim 3, wherein the stream data regeneration block comprises:

a first stored stream data generator configured to generate the first stored stream data;

a divider configured to divide the oscillator clock by the first stored stream data;

a second stream data generator configured to generate the second stored stream data;

a stream data buffer configured to store the first stored stream data and the second stored stream data and provide the second stored stream data to the divider; and a selection circuit configured to select and output the link symbol clock, the first stream data, and the second stream data as the reference clock, the first regenerated stream data, and the second regenerated stream data in the general mode, and select and output the oscillator clock, the first stored stream data, and the second stored stream data stored in the stream data buffer as the reference clock, the first regenerated stream data, and the second regenerated stream data according to the panel mode signal in the panel self refresh mode.

5. The eDP system of claim 4, wherein the first stored stream data generator generates a value of the first stored stream data based on relation between the link symbol clock and the oscillator clock, which is defined as follows:

$$f_OSC_CLK = \frac{N^*}{N} \times f_LS_CLK$$

and $$\frac{N}{f_LS_CLK} = \frac{N^*}{f_OSC_CLK},$$

where f_OSC_CLK represents a frequency of the oscillator clock, f_LS_CLK represents a frequency of the link symbol clock, N represents the first stream data, and N* represents the first stored stream data.

6. The eDP system of claim 4, wherein the second stored stream data generator generates a value of the second stored stream data based on a relation between the stream clock and the oscillator clock, which is defined as follows:

$$f_STR_CLK = \frac{M^*}{N^*} \times f_OSC_CLK$$

and $$\frac{M^*}{f_STR_CLK} = \frac{N^*}{f_OSC_CLK} = \frac{1}{f_D_CLK},$$

where f_STR_CLK represents a frequency of the stream clock, f_OSC_CLK represents a frequency of the oscillator clock, N* represents the first stored stream data, and M* represents the second stored stream data.

7. The eDP system of claim 3, wherein the stream clock recovery block comprises:

a first divider configured to generate a reference pulse by dividing the reference clock by the first regenerated stream data;

a second divider configured to generate a feedback pulse by dividing the stream clock by the second regenerated stream data; and a stream clock recovery circuit configured to compare the reference pulse of the first divider to the feedback pulse of the second divider and recover and output the stream clock.

8. The eDP system of claim 3, wherein the stream clock recovery block recovers the stream clock in the panel self refresh mode based on a relation between the stream clock and the oscillator clock, which is defined as follows:

$$f_STR_CLK = \frac{M^*}{N^*} \times f_OSC_CLK,$$

where f_STR_CLK represents a frequency of the stream clock, N* represents the first stored stream data, M* represents the second stored stream data, and f_OSC_represents a frequency of the oscillator clock.

9. An eDP system comprising a timing controller configured to recover a stream clock, wherein the timing controller comprises:

an oscillator configured to provide an oscillator clock;

a stream data regeneration block configured to output a link symbol clock, first stream data, and second stream data, transmitted from a source device, store a number, as first stored stream data, based on the oscillator clock, the link symbol clock, and the first stream data, store a number, as second stored stream data, based on the stream clock, the oscillator clock, and the first stored stream data, and output the oscillator clock, the first stored stream data, and the second stored stream data as a reference clock, first regenerated stream data, and second regenerated stream data according to a panel mode signal in a panel self refresh mode; and a stream clock recovery block configured to recover the stream clock using the reference clock, the first regenerated stream data, and the second regenerated stream data.

10. The eDP system of claim 9, wherein the stream data regeneration block is configured to output the link symbol clock, the first stream data, and the second stream data as the reference clock, the first regenerated stream data, and the second regenerated stream data in a general mode, the stream data regeneration block comprises:

a first stored stream data generator configured to generate the first stored stream data;

a divider configured to divide the oscillator clock by the first stored stream data;

a second stream data generator configured to generate the second stored stream data;

a stream data buffer configured to store the first stored stream data, and the second stored stream data and provide the second stored stream data to the divider; and a selection circuit configured to select and output the link symbol clock, the first stream data, and the second stream data as the reference clock, the first regenerated stream data, and the second regenerated stream data in the general mode, and select and output the oscillator clock, the first stored stream data, and the second stored stream data stored in the stream data buffer as the reference clock, the first regenerated stream data, and the second regenerated stream data according to the panel mode signal in the panel self refresh mode.

11. The eDP system of claim 10, wherein the first stored stream data generator generates a value of the first stored stream data based on a relation between the link symbol clock and the oscillator clock, which is defined as follows:

$$f_OSC_CLK = \frac{N^*}{N} \times f_LS_CLK$$

and $$\frac{N}{f_LS_CLK} = \frac{N^*}{f_OSC_CLK},$$

where f_OSC_CLK represents a frequency of the oscillator clock, f_LS_CLK represents a frequency of the link symbol clock, N represents the first stream data, and N* represents the first stored stream data.

12. The eDP system of claim 10, wherein the second stored stream data generator generates a value of the second stored stream data based on a relation between the stream clock and the oscillator clock, which is defined as follows:

$$f_STR_CLK = \frac{M^*}{N^*} \times f_OSC_CLK$$

and $$\frac{M^*}{f_STR_CLK} = \frac{N^*}{f_OSC_CLK} = \frac{1}{f_D_CLK},$$

where f_STR_CLK represents a frequency of the stream clock, f_OSC_CLK represents a frequency of the oscillator clock, N* represents the first stored stream data, and M* represents the second stored stream data.

13. The eDP system of claim 9, wherein the stream clock recovery block comprises:

a first divider configured to generate a reference pulse by dividing the reference clock by the first regenerated stream data;

a second divider configured to generate a feedback pulse by dividing the stream clock by the second regenerated stream data; and a stream clock recovery circuit configured to compare the reference pulse of the first divider to the feedback pulse of the second divider and recover and output the stream clock.

14. The eDP system of claim 9, wherein the stream clock recovery block recovers the stream clock in the panel self refresh mode based on a relation between the stream clock and the oscillator clock, which is defined as follows:

$$f_STR_CLK = \frac{M^*}{N^*} \times f_OSC_CLK,$$

where f_STR_CLK represents a frequency of the stream clock, N* represents the first stored stream data, M* represents the second stored stream data, and f_OSC_CLK represents a frequency of the oscillator clock.

15. An eDP system comprising a timing controller configured to generate a reference clock for recovering a stream clock, wherein the timing controller comprises:

an oscillator configured to provide an oscillator clock;

a first stored stream data generator configured to generate first stored stream data based on oscillator clock, a link symbol clock, and first stream data transmitted from a source device;

a divider configured to divide the oscillator clock by the first stored stream data;

a second stored stream data generator configured to generate second stored stream data based on a the stream clock and the divided clock outputted from the divider;

a stream data buffer configured to store the first stored stream data and the second stored stream data and provide the second stored stream data to the divider; and a selection circuit configured to select and output the link symbol clock, the first stream data, and the second stream data as the reference clock, first regenerated stream data, and second regenerated stream data in a general mode and select and output the oscillator clock, the first stored stream data, and the second stored stream data stored in the stream data buffer as the reference clock, the first regenerated stream data, and the second regenerated stream data in response to a panel mode signal in a panel self refresh mode.

16. The eDP system of claim 15, wherein the first stored stream data generator generates a value of the first stored stream data based on a relation between the stream clock and the oscillator clock, which is defined as follows:

$$f_OSC_CLK = \frac{N^*}{N} \times f_LS_CLK$$

and $$\frac{N}{f_LS_CLK} = \frac{N^*}{f_OSC_CLK},$$

where f_OSC_CLK represents a frequency of the oscillator clock, f_LS_CLK represents a frequency of the link symbol clock, N represents the first stream data, and N* represents the first stored stream data.

17. The eDP system of claim 15, wherein the second stored stream data generator generates a value of the second stored stream data based on a relation between the link symbol clock and the oscillator clock, which is defined as follows:

$$f_STR_CLK = \frac{M^*}{N^*} \times f_OSC_CLK$$

and $$\frac{M^*}{f_STR_CLK} = \frac{N^*}{f_OSC_CLK} = \frac{1}{f_D_CLK},$$

where f_STR_CLK represents a frequency of the stream clock, f_OSC_CLK represents a frequency of the oscillator clock, N* represents the first stored stream data, and M* represents the second stored stream data.

18. A method for controlling a panel self refresh mode of an eDP system, the method comprising:

storing a number, as first stored stream data, based on an oscillator clock provided from an oscillator, a link symbol clock, and first stream data having a fixed value;

storing a number, as second stored stream data, based on a stream clock, the oscillator clock, and the first stored stream data;

outputting the oscillator clock, the first stored stream data, and the second stored stream data as a reference clock, first regenerated stream data, and second regenerated stream data; and recovering the stream clock in the panel self refresh mode using the reference clock, the first regenerated stream data, and the second regenerated stream data.

19. The method of claim 18, wherein the first stored stream data is generated based on a relation between the link symbol clock and the oscillator clock, which is defined as follows:

$$f_OSC_CLK = \frac{N^*}{N} \times f_LS_CLK$$

and $$\frac{N}{f_LS_CLK} = \frac{N^*}{f_OSC_CLK},$$

where f_OSC_CLK represents a frequency of the oscillator clock, f_LS_CLK represents a frequency of the link symbol clock, N represents the first stream data, and N* represents the first stored stream data.

20. The method of claim 18, wherein the second stored stream data is generated based on a relation between the stream clock and the oscillator clock, which is defined as follows:

$$f_STR_CLK = \frac{M^*}{N^*} \times f_OSC_CLK$$

and $$\frac{M^*}{f_STR_CLK} = \frac{N^*}{f_OSC_CLK} = \frac{1}{f_D_CLK},$$

where f_STR_CLK represents a frequency of the stream clock, f_OSC_CLK represents a frequency of the oscillator clock, N* represents the first stored stream data, and M* represents the second stored stream data.

* * * * *